US006283313B1

(12) United States Patent
Schäfer

(10) Patent No.: US 6,283,313 B1
(45) Date of Patent: Sep. 4, 2001

(54) STIFFENER FOR MODULAR SHELF SYSTEM

(75) Inventor: Gerhard Schäfer, Neunkirchen (DE)

(73) Assignee: Fritz Schafer GmbH, Neunkirchen (DE)

( * ) Notice: Subject to any disclaimer, the term of this patent is extended or adjusted under 35 U.S.C. 154(b) by 0 days.

(21) Appl. No.: 09/464,761

(22) Filed: Dec. 16, 1999

(30) Foreign Application Priority Data

Dec. 18, 1998 (DE) ..... 198 58 598

(51) Int. Cl.[7] ..... A47F 5/00
(52) U.S. Cl. ..... 211/186
(58) Field of Search ..... 211/186, 183, 211/189, 191, 182, 192

(56) References Cited

U.S. PATENT DOCUMENTS

| | | | | |
|---|---|---|---|---|
| 3,871,525 | * | 3/1975 | Al-Dabbach et al. | 211/176 |
| 3,999,875 | * | 12/1976 | Simon . | |
| 4,030,612 | * | 6/1977 | Gray | 211/192 |
| 4,064,996 | * | 12/1977 | Shillum | 211/191 |
| 4,067,445 | * | 1/1978 | Derclaye | 211/191 |
| 4,142,637 | * | 3/1979 | Kraiss | 211/182 |
| 4,423,817 | * | 1/1984 | Monjo-Rufi | 211/187 |
| 4,648,517 | * | 3/1987 | Schafer | 211/183 |
| 4,742,782 | * | 5/1988 | Miller . | |
| 4,949,648 | * | 8/1990 | Miller . | |
| 5,161,701 | * | 11/1992 | Berny | 211/193 |
| 5,295,446 | * | 3/1994 | Schafer . | |

* cited by examiner

*Primary Examiner*—Alvin Chin-Shue
*Assistant Examiner*—Sarah Purol
(74) *Attorney, Agent, or Firm*—Herbert Dubno; Andrew Wilford

(57) ABSTRACT

A pair of back-to-back shelf systems each have a plurality of horizontal and polygonal shelf panels and respective front and back vertical standards at corners of the panels and each formed with a vertical row of holes. Each of the back standards of one of the systems is closely juxtaposed with a respective one of the back standards of the other system. A stiffener has a vertical and rigid center panel lying between the systems and having a pair of opposite and upright end edges each at two of the back standards. Respective pairs of oppositely directed hook flanges project from each of the end edges with each hook flange projecting toward a respective one of the back standards. A respective downwardly directed hook is provided on one of each of the pairs of hook flanges projecting through one of the holes of the respective standard and a respective upwardly directed hook is provided on each of the other of the pairs of hook flanges projecting through one of the holes of the respective standard.

9 Claims, 2 Drawing Sheets

STIFFENER FOR MODULAR SHELF SYSTEM

FIELD OF THE INVENTION

The present invention relates to a modular shelf system comprised of upright standards or posts and horizontal shelf panels. More particularly this invention concerns a stiffener for such a shelf system.

BACKGROUND OF THE INVENTION

A standard modular shelf system is formed by four identical standards normally made of sheet metal and each formed with a row of attachments, and a plurality of normally rectangular shelf panels. The standards are set vertically at corners of the panels where they are attached to the panels. The result is a shelf system that can be modified, expanded, and taken down and reassembled relatively easily.

While such a shelf system is carrying a considerable load, it has little lateral strength and therefore needs to be stiffened if it is to withstand any type of lateral load. Thus as described in U.S. Pat. No. 4,648,517 of Schafer stiffeners are used. The simplest stiffener is one or more diagonal struts secured between the standards. Alternately panels can be used which are connected to the standards and extend vertically. Such panels not only stiffen the system, but form a side or back wall for the shelves, making the systems somewhat easier to use than purely open shelving.

OBJECTS OF THE INVENTION

It is an object of the present invention to provide an improved stiffened shelf system.

Another object is the provision of such an improved shelf-system stiffener which is of simple construction, takes up little space, and is easy to install.

SUMMARY OF THE INVENTION

A pair of back-to-back shelf systems each have a plurality of horizontal and polygonal shelf panels and respective front and back vertical standards at corners of the panels and each formed with a vertical row of holes. Each of the back standards of one of the systems is closely juxtaposed with a respective one of the back standards of the other system. A stiffener has according to the invention a vertical and rigid center panel lying between the systems and having a pair of opposite and upright end edges each at two of the back standards. Respective pairs of oppositely directed hook flanges project from each of the end edges with each hook flange projecting toward a respective one of the back standards. A respective downwardly directed hook is provided on one of each of the pairs of hook flanges projecting through one of the holes of the respective standard and a respective upwardly directed hook is provided on each of the other of the pairs of hook flanges projecting through one of the holes of the respective standard.

Such a stiffener is first hooked by means of its downwardly directed hooks to the back of one shelf system so as to rigidify and close the back of that shelf system. Then the back of another shelf system is set down on the stiffener to rigidify this system and close its back. The result is a two-sided shelf system that is extremely stable, much more stable than two standard shelf systems standing back-to-back.

According to the invention each standard is formed with a full-length groove having a floor formed with the respective row of holes. Thus the hook flange engages deeply into this groove, further increasing the stability of the system. Furthermore each end edge is provided with a generally U-section hook strip having a short flange fixed to the respective end edge and a long flange engaged in the respective groove and formed with the respective hook. In addition each end edge has an outer mounting flange lying between and fastened to the respective hook strip and an inner mounting flange fixed to the center panel. Adjacent back standards are therefore only spaced apart by the thickness of the three metal plates—the floors of the two hook strips and the short flange of the edge flange—so the system is also fairly compact.

The center panel in accordance with the invention is formed with horizontal corrugations and the inner mounting flange is formed as a row of tabs secured to the corrugations.

Each flange according to the invention is formed with a vertical row of such hooks and the hooks of one flange of each pair of flanges are offset vertically from the hooks of the other flange of the respective pair of flanges. Each hook flange is unitary with the respective hooks.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
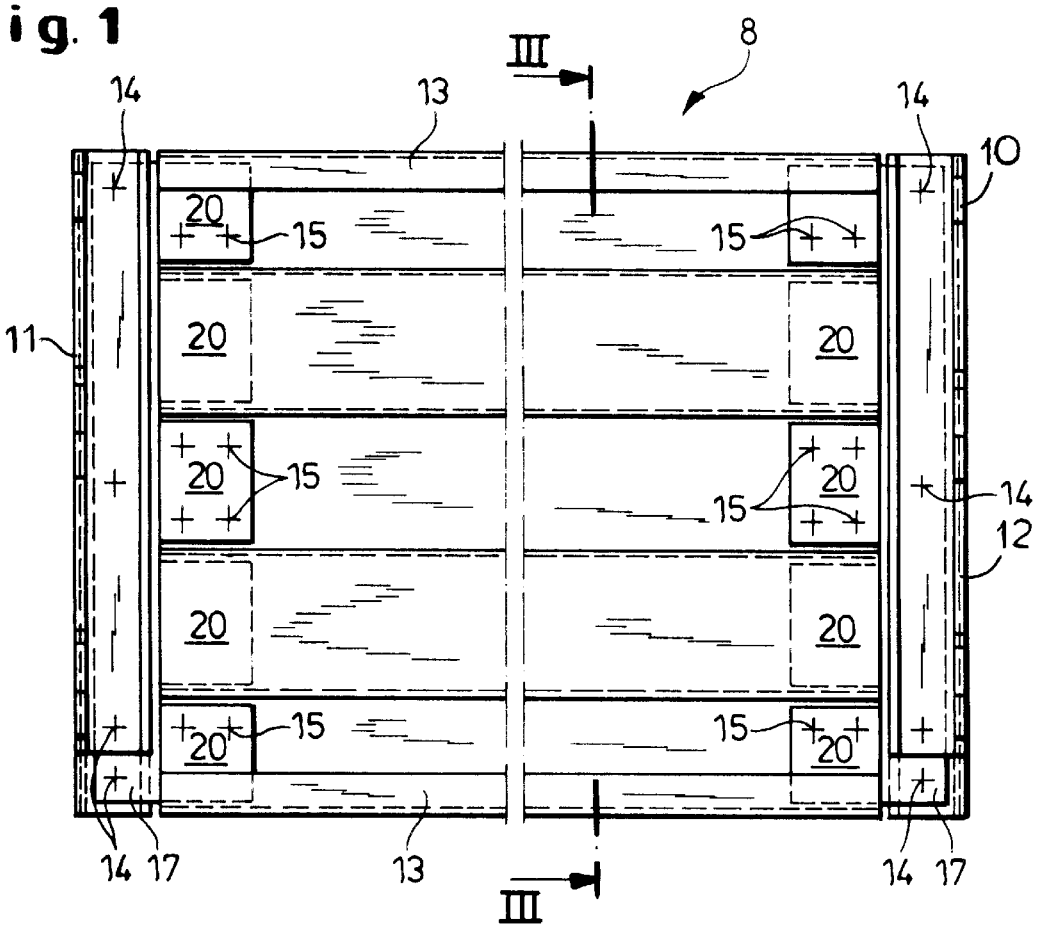
FIG. 1 is a front view of a stiffener according to the invention.
Figure 2:
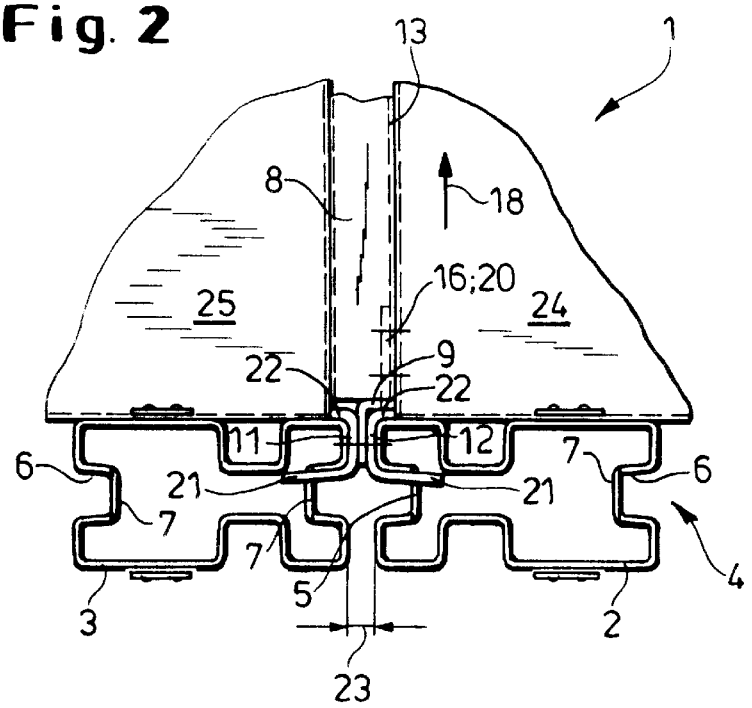
FIG. 2 is a vertical section through a portion of a shelf system equipped with the stiffener of this invention.
Figure 5:
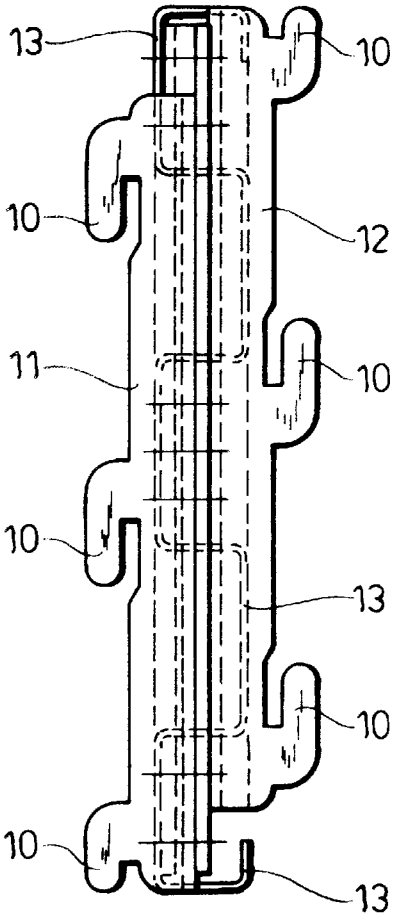
FIG. 5 is an end view of the stiffener taken in the direction of arrow V of FIG. 11.
Figure 4:
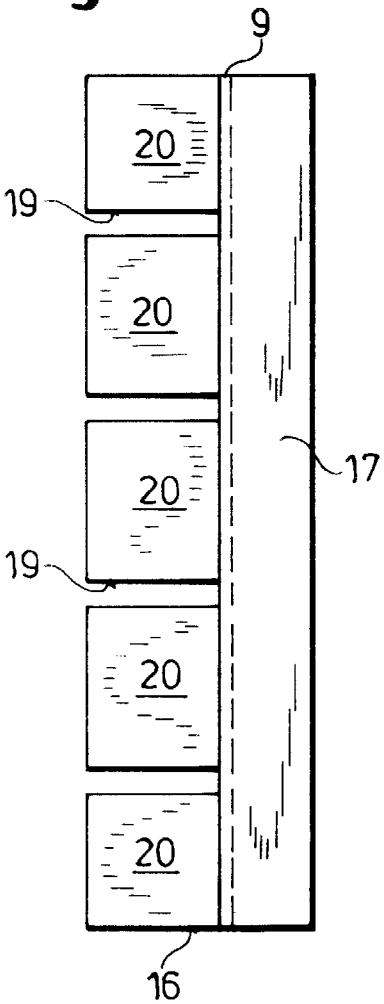
FIG. 4 is a side view of part of the stiffener.
Figure 3:
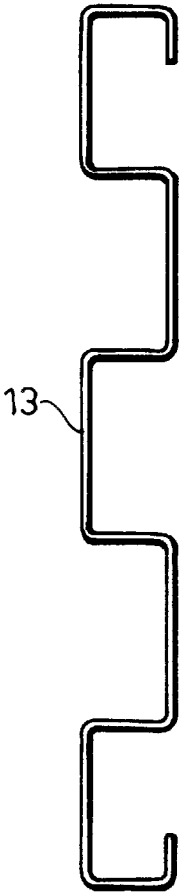
FIG. 3 is a section taken along line III—III of FIG. 1.

As seen in FIG. 2 a double shelf system 1 has back corner posts or standards 2 and 3 formed of sheet metal and having end edges 4 each formed with a full-length square groove 6 in the floor 5 of which is formed a series of mounting holes 7. Shelf panels 24 and 25 are secured in a manner not shown in further detail to these standards 2 and 3, it being understood that the panels 24 and 25 are rectangular and have a standard 2 or 3 in each back corner and other identical standards in the unillustrated front corners.

According to the invention a stiffener 8 comprises a corrugated or ribbed center panel 13 secured between a pair of end strips 9. To this end the zig-zag edge strips 9 each have a short web 17 that projects between the adjacent standards 2 and 3 and a wide web 16 extending in the horizontal longitudinal direction 18 of the system and subdivided by slots 19 into tabs 20 that fit in the corrugations of the center panel 13 to which they are secured by spot welds 15. A pair of J-section hook strips 11 and 12 each have an inner web 22 lying against the web or flange 17 and an outer web 21 extending perpendicular to the direction 18 and formed with a series of hooks 10 adapted to engage in the holes 7. The hooks 10 of the strip 11 are directed downward and the hooks 10 of the strip 12 are directed upward. The panels 13 and strips 9, 11, and 12 are all normally made of sheet steel.

The stiffener 8 creates a narrow space 23 between the standards 2 and 3 that is filled by the floor webs of the hook strips 11 and 12 and the narrow web 17 of the edge strip 9 while the space between the back edges of the shelf panels

24 and 25 is largely filled by the corrugated plate 13. Not only does the stiffener 8 prevent the shelf system from racking, that is moving from a square to a parallelogrammatic shape, but it also provides a solid back for the shelves it is installed behind.

With the system of this invention once one set of shelves is built, one or more of the stiffeners 8 is installed on it by hooking the downwardly directed hooks 10 of the strip 11 in its backwardly open holes 7. Then the other shelf system is positioned adjacent it and lifted somewhat to engage the upwardly directed hooks 10 of the strips 12 in its backwardly open holes 10, and is slid down to lock the system together. Disassembly is the reverse process and, like assembly, requires no tools.

I claim:

1. In combination with a pair of back-to-back shelf systems each having a plurality of horizontal and polygonal shelf panels; and respective front and back vertical standards at corners of the panels and each formed with a vertical row of holes, each of the back standards of one of the systems being closely juxtaposed posed with a respective one of the back standards of the other system, a stiffener comprising a vertical and rigid center panel lying between the systems and having a pair of opposite and upright end edges each at two of the back standards;

respective pairs of oppositely directed hook flanges projecting from each of the end edges, each hook flange projecting toward a respective one of the back standards;

a respective downwardly directed hook on one of each of the pairs of hook flanges projecting through one of the holes of the respective standard; and a respective upwardly directed hook on each of the other of the pairs of hook flanges projecting through one of the holes of the respective standard.

2. The shelf-system combination defined in claim 1 wherein each standard is formed with a full-length groove having a floor formed with the respective row of holes.

3. The shelf-system combination defined in claim 2 wherein each end edge is provided with a generally U-section hook strip having a short flange fixed to the respective end edge and a long flange engaged in the respective groove and formed with the respective hook.

4. The shelf-system combination defined in claim 3 wherein each end edge has an outer mounting flange lying between and fastened to the respective hook strip.

5. The shelf-system combination defined in claim 4 wherein each end edge has an inner mounting flange fixed to the center panel.

6. The shelf-system combination defined in claim 5 wherein the center panel is formed with horizontal corrugations and the inner mounting flange is formed as a row of tabs secured to the corrugations.

7. The shelf-system combination defined in claim 1 wherein each flange is formed with a vertical row of such hooks.

8. The shelf-system combination defined in claim 7 wherein the hooks of one flange of each pair of flanges are offset vertically from the hooks of the other flange of the respective pair of flanges.

9. The shelf-system combination defined in claim 7 wherein each flange is unitary with the respective hooks.

* * * * *